US005593142A

United States Patent [19]

Gerhart

[11] Patent Number: 5,593,142

[45] Date of Patent: Jan. 14, 1997

[54] STRETCH THRU FASTENER

[76] Inventor: Thomas L. Gerhart, 6265 US Highway 89, Belt, Mont. 59412

[21] Appl. No.: 570,556

[22] Filed: Dec. 11, 1995

[51] Int. Cl.[6] ..... E04H 17/02

[52] U.S. Cl. ..... 256/54; 256/47; 256/32

[58] Field of Search ..... 256/47, 54, 58, 256/48, 32, 19; 174/152 G, 152 R, 153 G, 48; 52/220.1, 220.2, 220.7

[56] References Cited

U.S. PATENT DOCUMENTS

| | | | |
|---|---|---|---|
| 1,079,043 | 11/1913 | Fisher . | |
| 1,336,205 | 4/1920 | Davis . | |
| 1,356,991 | 10/1920 | Lane . | |
| 1,630,441 | 5/1927 | Lotz . | |
| 1,644,846 | 10/1927 | Morris . | |
| 2,291,430 | 7/1942 | Ingersoll | 174/153 G X |
| 3,387,825 | 6/1968 | Kreeger | 256/47 X |
| 3,491,971 | 1/1970 | Fisher | 248/65 |
| 4,018,425 | 4/1977 | Sasena | 256/54 |
| 4,602,764 | 7/1986 | Cacicedo | 256/11 |
| 4,836,504 | 6/1989 | Fingerson et al. | 256/10 |
| 4,982,932 | 1/1991 | Baker | 256/47 |
| 5,085,409 | 2/1992 | Teixeira | 256/48 |

FOREIGN PATENT DOCUMENTS

| | | | |
|---|---|---|---|
| 202989 | 11/1955 | Australia | 256/19 |
| 906529 | 1/1946 | France . | |

*Primary Examiner*—Anthony Knight

[57] ABSTRACT

The Stretch Thru Fastener is a simple length of a galvanized metal or plastic round tube flared at both ends, split length wise once so it can be slipped over the fence wire, and a clamp at each end to hold the Stretch Thru Fastener on the post while holding wire is attached, one slight groove to fit over the small shoulder on the face of a T-shaped steel post. The Stretch Thru Fastener will provide a way to hold the wire to the post and allow easy passage of the wire through a holder or fastener.

9 Claims, 1 Drawing Sheet

STRETCH THRU FASTENER

STRETCH THRU FASTENER

BACKGROUND OF THE INVENTION

This invention relates mainly to attaching barbed wire to steel posts.

BACKGROUND-DESCRIPTION OF PRIOR ART

The only products I have seen on the market in my 62 years of life for attaching wire (barbed or other) to steel or other types of posts are:

1). A metal U-shaped staple that can be drive into soft material.

2). A short piece of pre-shaped, rather stiff wire that is wrapped tightly around the wire on one side of the steel post, around the back of the steel post, and around the wire on the other side of the post.

3). A plastic holder that clips or is nailed to the post, used mainly for electric fences.

OBJECTS/ADVANTAGES

The main complaint voiced (especially by barbed wire users) is when wire gets slack or loose, it is impossible or troublesome to stretch the wire through the existing products. Also, they become loose or disengaged.

(A) The Stretch Thru Fastener provides a way to hold the wire to the post and allows easy passage of the wire through a holder or fastener.

(B) The Stretch Thru Fastener is a simple, strong, long lasting, affordable, permanent, and much needed way, who's main purpose is to fasten barbed or smooth wire to steel posts. Also, by attaching the Stretch Thru Fastener with wire it is adaptable to most any situation. A nail, screw, or bolt could be passed through the split and into the shoulder groove and attached in that manner or in addition to the holding wire. By sliding a plastic liner inside the metal tube (for insulation) one could electrify the wire. I believe many more uses would be found to use the Stretch Thru Fastener.

(C) The Stretch Thru Fastener is made of a galvanized metal or plastic tube affording resistance to the elements of nature.

(D) The unique flared design would solve the problem of the barbs on the wire passing through other fasteners and allowing wire to be stretched for long distances.

(E) The Stretch Thru Fastener is a simple length of a galvanized metal or plastic round tube flared at both ends, split length wise once so The Stretch Thru Fastener can be slipped over the wire, flat where the Stretch Thru Fastener rests with a groove to fit over the shoulder on the face of the T-post and clamps that fit over both edges of the face of the T-post to hold the Stretch Thru Fastener to the T-post while installing the attaching wire.

REFERENCE NUMERALS IN DRAWING

10. Shoulder groove
11. Flair
12. Split
13. Steel T-shaped post
14. Stretch Thru Fastener
15. Barbed wire
15A. Barb
16. Ground or earth
17. Attaching wire
18. Knobs

19. Shoulder
20. Clamps

THE DRAWING

DETAILED DESCRIPTION

Figure 1:
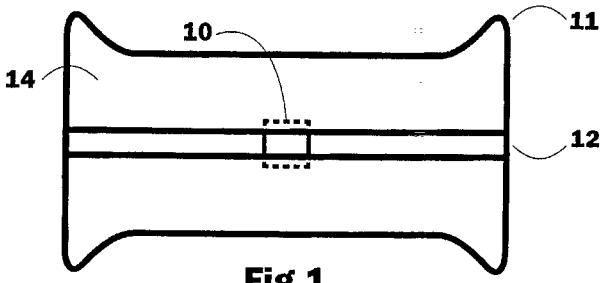
FIG. 1 is a front view of the embodiment of the Stretch Thru Fastener.

FIG. 1 Stretch Thru Fastener (10) Slight groove to fit over slight shoulder running the full length of the face of the T-Post. (11) Flair at both ends of the Stretch Thru Fastener to allow barbs on the wire to pass through without hanging up. (12) Split in Stretch Thru Fastener to allow fastener to be slipped over the wire.

Figure 2:
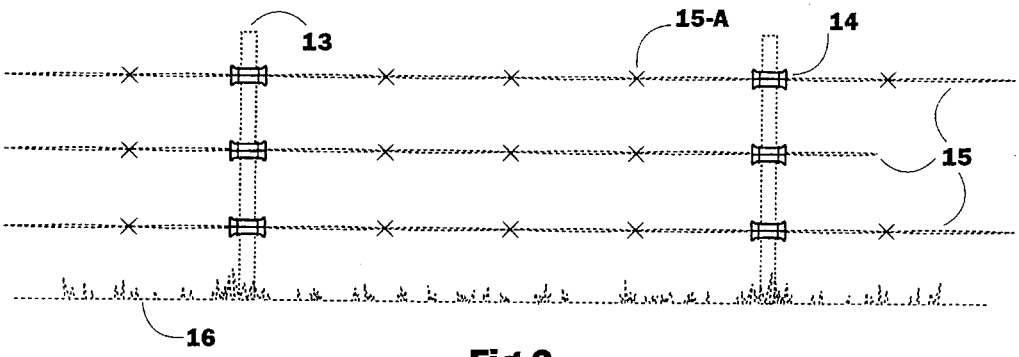
FIG. 2 is a front view of the Stretch Thru Fastener mounted on the standing posts with the barbed wire running through them.

FIG. 2 Standing Fence (13) Steel T-Posts. (14) Stretch Thru Fasteners. (15) Barbed Wire. (15A) Barbs on the Wire. (16) Ground or earth.

Figure 3:
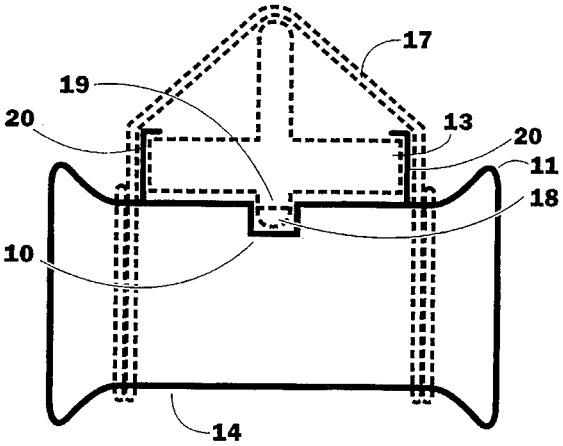
FIG. 3 is a top view of a steel T-Post with the Stretch Thru Fastener wired to it.

FIG. 3 Top View of Stretch Thru Fastener, T-Post, and Attaching Wire (10) Shoulder Groove. (13) Steel T-Post. (14) Stretch Thru Fastener. (17) Stretch Thru Fastener attaching wire. (19) Shoulder. (20) Clamps to hold the Stretch Thru Fastener to post while installing attaching wire.

Figure 4:
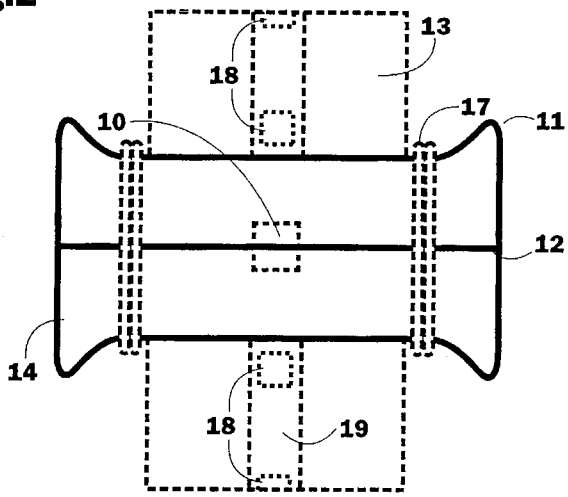
FIG. 4 is a front view of a steel T-Post with the Stretch Thru Fastener attached.

FIG. 4 Front View of T-Post and Fastener (10) Shoulder Groove (12) Split. (13) Steel T-Post. (14) Stretch Thru Fastener. (17) Fastener attaching wire. (18) Knobs. (19) Shoulder.

I claim:

1. A fastener for securing a fence wire to a steel T-post, comprising:

an elongated, hollow tube having a body portion and flared end portions;

said hollow tube having a back portion which is positioned adjacent the T-post when the fastener is mounted thereon;

said hollow tube having a slit formed therein which extends the length thereof for receiving the fence wire to enable the fence wire to be positioned in and extend through said hollow tube;

said body portion of said hollow tube having an inside diameter substantially greater than the diameter of the fence wire to enable the fence wire to be selectively longitudinally moved with respect thereto when it is desired to stretch the fence wire;

and first connection means for securing said hollow tube to the T-post whereby said hollow tube is substantially horizontally disposed.

2. The fastener of claim 1 wherein said flared ends each have a diameter sufficiently large enough to permit barbs to move therethrough.

3. The fastener of claim 1 wherein a second connection means also secures said hollow tube to the T-post which closes said slit after the fence wire is positioned therein.

4. The fastener of claim 1 wherein said hollow tube is comprised of a metal material.

5. The fastener of claim 1 wherein said hollow tube is comprised of a plastic material.

6. The fastener of claim 1 wherein the T-post has a protruding shoulder at one side thereof and wherein said back portion of said hollow tube has a groove formed therein for receiving the protruding shoulder of the T-post.

7. The fastener of claim 1 wherein said hollow tube has a front portion and wherein said slit is formed in said front portion of said hollow tube.

8. A fastener for securing a fence wire to a fence post, comprising:

an elongated, hollow tube having a body portion and flared end portions;

said hollow tube having a back portion which is positioned adjacent the fence post when the fastener is mounted thereon;

said hollow tube having a slit formed therein which extends the length thereof for receiving the fence wire to enable the fence wire to be positioned in and extend through said hollow tube;

said body portion of said hollow tube having an inside diameter substantially greater than the diameter of the fence wire to enable the fence wire to be selectively longitudinally moved with respect thereto when it is desired to stretch the fence wire;

and first connection means for securing said hollow tube to the fence post whereby said hollow tube is substantially horizontally disposed.

9. The fastener of claim 8 wherein a second connection means also secures said hollow tube to the fence post which closes said slit after the fence wire is positioned therein.

* * * * *